US007017458B2

(12) United States Patent
Poole et al.

(10) Patent No.: US 7,017,458 B2
(45) Date of Patent: Mar. 28, 2006

(54) SELF ADJUSTING GROOVED PLIERS

(76) Inventors: Daniel L. Poole, 5425 W. Paradise Ln., Glendale, AZ (US) 85306; Robert N. Poole, 19777 N. 76th St., No. 1164, Scottsdale, AZ (US) 85255

( * ) Notice: Subject to any disclaimer, the term of this patent is extended or adjusted under 35 U.S.C. 154(b) by 0 days.

(21) Appl. No.: 10/632,357

(22) Filed: Aug. 1, 2003

(65) Prior Publication Data

US 2004/0020333 A1 Feb. 5, 2004

Related U.S. Application Data

(60) Provisional application No. 60/400,545, filed on Aug. 1, 2002.

(51) Int. Cl.
*B25B 7/04* (2006.01)

(52) U.S. Cl. ..... 81/414; 81/407; 81/411

(58) Field of Classification Search ..... 81/405–414, 81/409.5

See application file for complete search history.

(56) References Cited

U.S. PATENT DOCUMENTS

| | | | | |
|---|---|---|---|---|
| 1,508,510 A | | 9/1924 | Edwards | |
| 2,622,464 A | * | 12/1952 | Daugherty | 81/414 |
| 3,892,150 A | | 7/1975 | Horton | |
| 4,651,598 A | | 3/1987 | Warheit | |
| 4,662,252 A | | 5/1987 | Warheit | |
| 4,726,265 A | * | 2/1988 | Reich | 81/411 |
| 4,901,609 A | | 2/1990 | Crum | |
| 4,922,770 A | | 5/1990 | Dlugolecki | |
| 5,060,543 A | | 10/1991 | Warheit | |
| 6,019,020 A | * | 2/2000 | Liou | 81/407 |
| 6,101,908 A | | 8/2000 | Azkona | |
| 2003/0101852 A1 | * | 6/2003 | Martinka | 81/407 |

* cited by examiner

*Primary Examiner*—Debra S Meislin
(74) *Attorney, Agent, or Firm*—Parsons & Goltry; Robert A. Parsons; Michael W. Goltry

(57) ABSTRACT

Self adjusting grooved pliers include a first section having a jaw portion and a channel formed therethrough, adjacent the jaw portion and a second section having a jaw portion and a pivot extending therefrom. The pivot is slidably received in the channel to allow wider or narrower association between the jaw portion of the first section and the jaw portion of the second section. The pivot pivotally couples the first section to the second section for movement between an open position and a gripping position. A plurality of grooves is formed in the first section and a tongue extends from the second section. The tongue is received in one of the plurality of grooves, locking the pivot in position within the channel only upon the first section and the second section reaching the gripping position. A biasing assembly acts on the pivot, urging the pivot upward in the channel toward the jaw portion of the first section.

8 Claims, 7 Drawing Sheets

10
14
16
15
13
12
18
24
25
20
20a
26
28
29
22

SELF ADJUSTING GROOVED PLIERS

CROSS-REFERENCE TO RELATED APPLICATION

This application claims the benefit of U.S. Provisional Patent Application No. 60/400,545, filed Aug. 1, 2002.

FIELD OF THE INVENTION

This invention relates to hand tools.

More particularly, the present invention relates to grooved pliers.

In a further and more specific aspect, the instant invention concerns grooved pliers which are self adjusting.

BACKGROUND OF THE INVENTION

Pliers having jaws which are adjustable between various positions are well known in the art. Typically, these types of pliers include two halves each having a jaw portion the halves are coupled at a pivot by a bolt or rivet. One half includes a channel allowing the pivot to be adjusted by moving the bolt or rivet therealong for a wider or narrower association between the jaw portions of the halves. The conventional grooved pliers include a plurality of grooves formed in one half proximate the channel for receiving a tongue formed on the other half. The adjustment is accomplished by opening the pliers fully so that the tongue leaves the grooves, and sliding the two halves until the tongue on one section aligns with the desired groove on the other section. When the conventional pliers are closed a slight amount, the tongue enters the groove and is locked into that adjustment, preventing movement of the pivot in the channel until the sections are fully opened again. This adjustment requires the use of two hands, and careful alignment of the tongue with the desired groove, or the pliers will not close. More importantly, when in use if the pliers are at the wrong adjustment, the pliers must be removed and readjusted.

It would be highly advantageous, therefore, to remedy the foregoing and other deficiencies inherent in the prior art.

Accordingly, it is an object of the present invention to provide new and improved adjustable grooved pliers.

It is another object of the present invention to provide adjustable grooved pliers which are self adjusting.

Another object of the present invention is to provide grooved pliers which can be adjusted with one hand.

Yet another object of the present invention is to provide adjustable grooved pliers which can be adjusted while engaging an object.

SUMMARY OF THE INVENTION

Briefly, to achieve the desired objects of the instant invention in accordance with a preferred embodiment thereof, provided are self adjusting grooved pliers include a first section having a jaw portion and a channel formed therethrough adjacent the jaw portion and a second section having a jaw portion and a pivot extending therefrom. The pivot is slidably received in the channel to allow wider or narrower association between the jaw portion of the first section and the jaw portion of the second section. The pivot pivotally couples the first section to the second section for movement between an open position and a gripping position. A plurality of grooves is formed in the first section and a tongue extends from the second section. The tongue is received in one of the plurality of grooves, locking the pivot in position within the channel only upon the first section and the second section reaching the gripping position. A biasing assembly acts on the pivot, urging the pivot upward in the channel toward the jaw portion of the first section.

In another aspect of the present invention, the biasing assembly includes a coil spring fitted into a handle portion of the first section and an extension member having an end engaging the coil spring and an opposing end extending into the channel and engaging the pivot. The coil spring and the extension cooperate to urge the pivot in the channel toward the first jaw portion.

In another aspect, the biasing assembly includes a post extending from the pivot into a receptacle extending from the first section and a coil spring carried by the post within the receptacle. The compression spring is compressed between the pivot and the receptacle.

In yet another aspect, the second jaw portion of the second section is carried by a jaw element pivotally coupled to the second section. The jaw element is movable between a start position and a finish position, and is biased into the start position by a biasing member.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figures 1, 2:
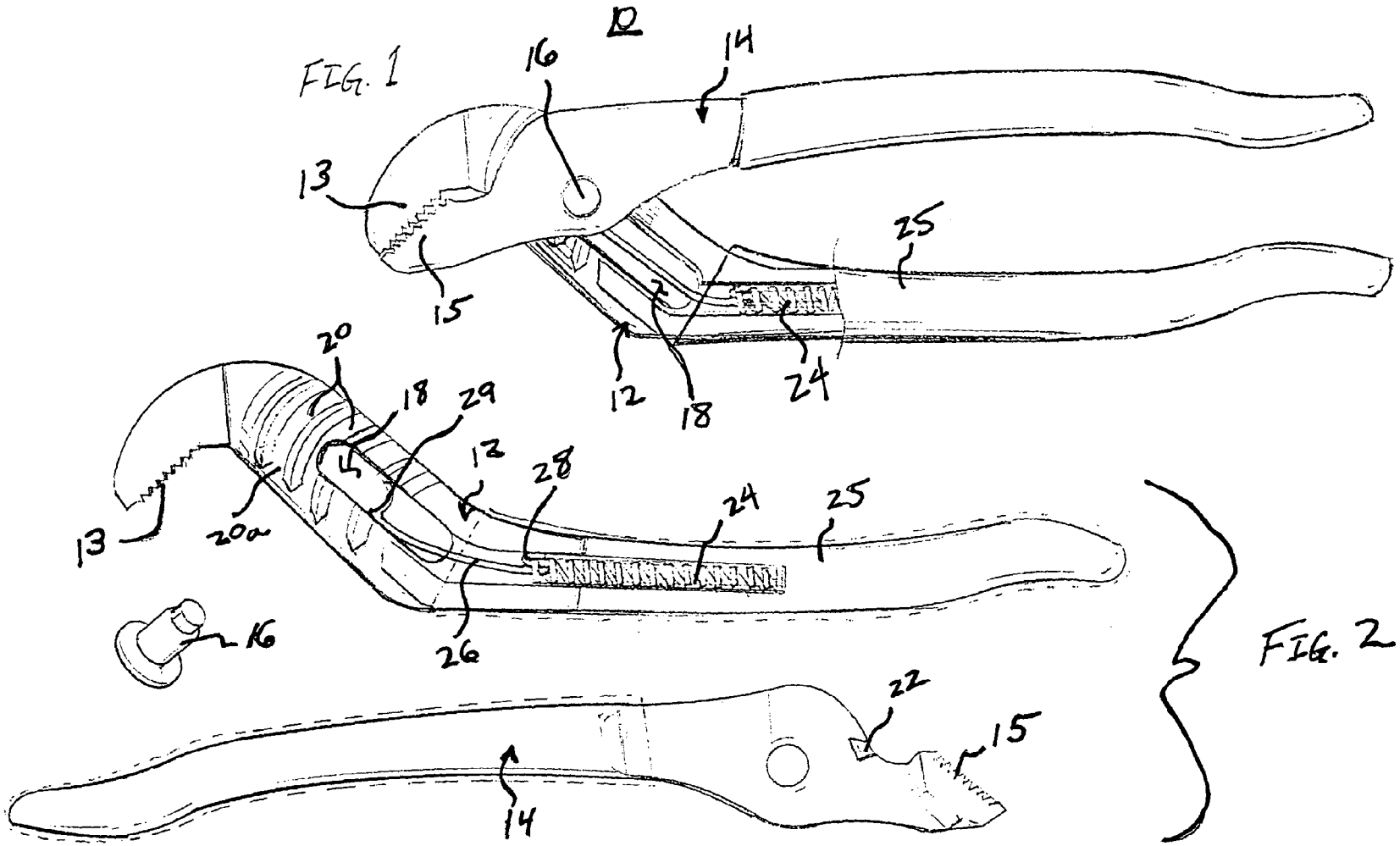
FIG. 1 is a plan view of self adjusting grooved pliers according to the present invention.
FIG. 2 is a disassembled plan view of the pliers of FIG. 1.

Turning now to the drawings in which like reference characters indicate corresponding elements throughout the several views, attention is first directed to FIG. 1 which illustrates self adjusting grooved pliers generally designated 10. Pliers 10 are similar to conventional grooved pliers with the exception that modifications have been made to the grooves and tongues, as will be described presently, and a biasing mechanism has been added, which while advantageous, is not required. Pliers 10 include a section 12 having a jaw portion 13 and a section 14 having a jaw portion 15, coupled at a pivot 16. Section 12 includes a channel 18 adjacent jaw portion 13, which receives pivot 16, allowing pivot 16 between sections 12 and 14, to be adjusted for a wider or narrower association between jaw portions 13 and 15. Section 12 and section 14 pivot about pivot 16 moving jaw portions 14 and 15 between an open position and a gripping position.

Conventional grooved pliers include a plurality of grooves formed in one section proximate the channel for receiving a tongue formed on the other section. The adjustment is accomplished by opening the pliers fully so that the tongue leaves the grooves, and sliding the two sections until the tongue on one section aligns with the desired groove on the other section. When the conventional pliers are closed a slight amount, the tongue enters the groove and is locked into that adjustment, preventing movement of the pivot in the channel until the sections are fully opened again.

Pliers 10 of the present invention, includes grooves 20 formed in section 12 proximate channel 18 for receiving a tongue 22 formed on section 14. Tongue 22 is shortened to a tooth or nub when compared to existing grooved pliers tongues. Additionally, the positioning of tongue 22 is such that it enters one of grooves 20 slightly before or when jaws 13 and 15 come to a substantially parallel position with respect to one another. It will be understood by one skilled in the art that while tongue 22 is shortened in this preferred embodiment, it may be positioned in a radial position with respect to pivot 16 that the same effect occurs. By positioning tongue 22 in this manner, pliers 10 become self adjusting. Closing jaws 13 and 15 about an item to be engaged allows pivot 16 to travel along channel 18 until jaws 13 and 15 are substantially parallel (a preferred gripping position), at which point tongue 22 enter one of grooves 20, locking sections 12 and 14 in position and allowing the application of a clamping force to jaws 13 and 15. One skilled in the art will readily understand that while the preferred gripping position is when jaws 13 and 15 are parallel, or within a few degrees thereof, other gripping position can be employed. For example the gripping position can diverge from parallel by a few degrees or by many degrees as desired, as long as the gripping position is less than a fully open position.

Figure 4:
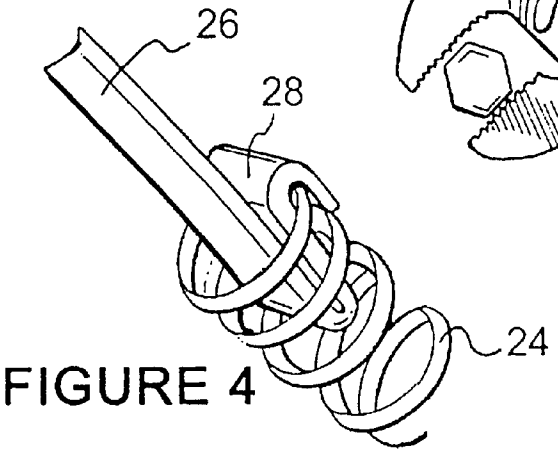
FIG. 4 is an enlarged perspective view of a portion of the biasing mechanism.

With additional reference to FIG. 4, a biasing assembly can be included which acts on pivot 16, urging it upward in channel 18, toward jaw 13 and into the smallest adjustment distance between jaws 13 and 15. In this embodiment, the biasing assembly includes a coil spring 24 fitted into a handle portion 25 of section 12 and an extension member 26. Extension member 26 is preferably formed of a spring material such as steel or plastic and has an end 28 engaging coil spring 24 and an opposing end 29 extending into channel 18 and engaging pivot 16. Coil spring 24 and extension cooperate to urge pivot 16 in channel 18 toward jaw 13. Thus when in use, jaws 13 and 15 are in the closest or smallest setting. Upon closing pliers 10, tongue 22 enters the first of grooves 20 designated 20*a*. Since the ideal gripping position of jaws 13 and 15 are when they are parallel, it is desirable that jaws 13 and 15 be spread apart a greater distance for larger items. When a larger item is clamped, the jaws are opened sufficiently to engage substantially opposing sides thereof. As the jaws are drawn together by the closing of section 12 and 14, pivot 16 slides back in channel 18 away from jaw 13 against the bias, until jaws 13 and 15 are substantially parallel or slightly before. At this point, by the positioning of tongue 22, tongue 22 enters an aligned one of grooves 20, locking sections 12 and 14 into position and permitting a clamping force to be applied by jaws 13 and 15 to the item being clamped. When pliers 10 is removed from engagement with the item clamped, the biasing assembly urges pivot upward in channel 18 with jaws 13 and 15 in the closest or smallest adjustment prior to the next clamping operation.

Figure 3:
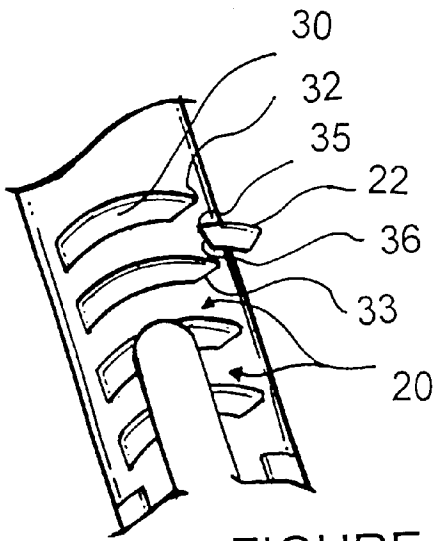
FIG. 3 is an enlarged view of the interaction of the tongue and grooves of the pliers of FIGS. 1 and 2.

Still referring to FIGS. 1 and 2, with additional reference to FIG. 3, grooves 20 are formed by a plurality of raised ridges 30 each having a leading edge 32 and a slanted leading face 33 slanting back therefrom. Tongue 22 also has a leading edge 35 and a slanted leading face 36 slanting back therefrom. Leading faces 33 and 36 act in concert as a centering mechanism. When leading edge 35 engages slanted leading face 33, tongue 22 is guided into the adjacent lower groove. When leading edge 33 of tongue 22 engages slanted leading face 36, tongue 22 is guided into an upper adjacent groove. In this manner, pliers 10 will always close smoothly without the need to manually align tongue 22 with one of grooves 20.

Figure 5:
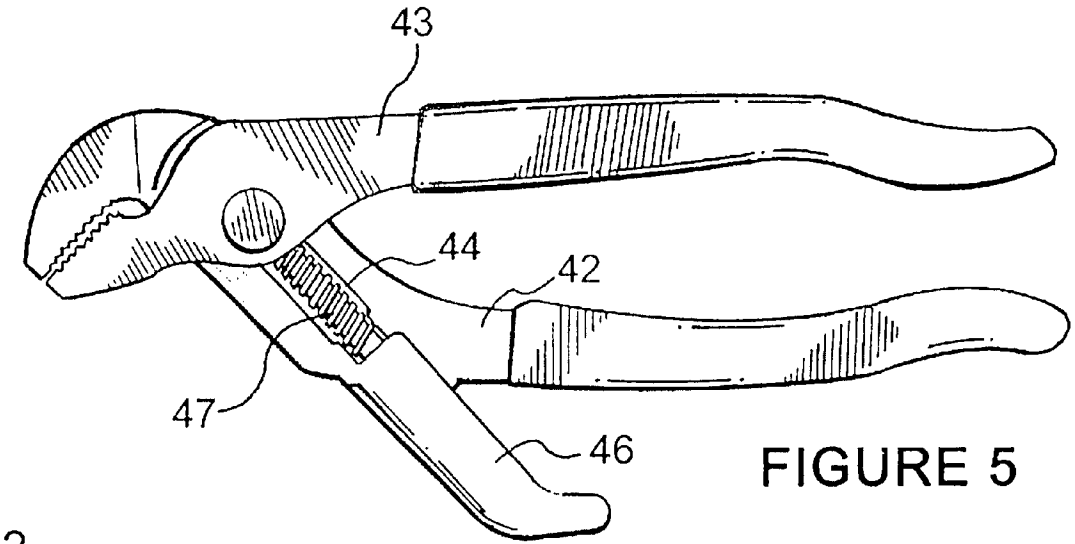
FIG. 5 is a plan view of self adjusting grooved pliers according to the present invention, illustrating another embodiment of a biasing mechanism.
Figure 6:
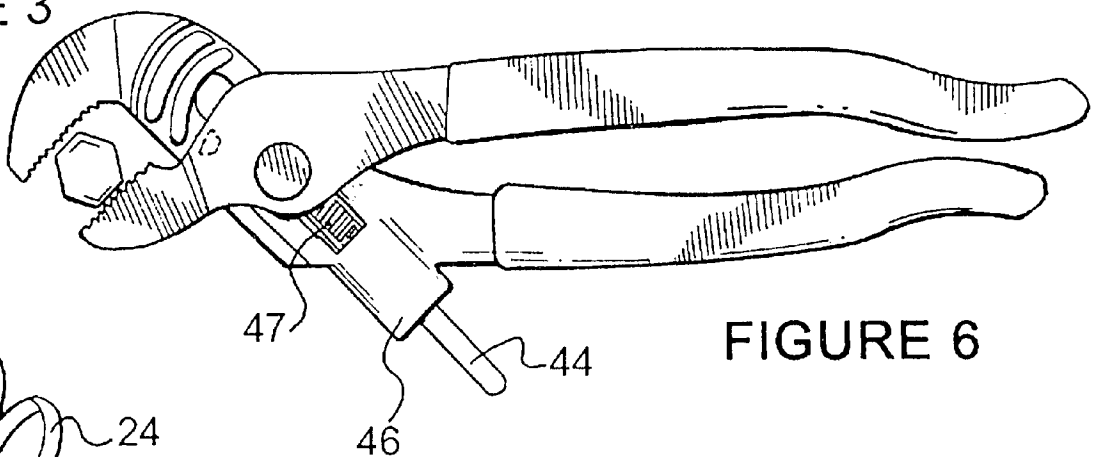
FIG. 6 is a plan view of self adjusting grooved pliers according to the present invention, illustrating yet another embodiment of a biasing mechanism.

Turning now to FIG. 5, another embodiment of a pair of pliers generally designated 40 is illustrated. Pliers 40 are substantially similar to pliers 10, including a section 42 having a channel therein, a section 43 and a pivot 44. A slight modification has been made to the biasing assembly. In this embodiment, the biasing assembly includes a post 45 extending from pivot 44 into a receptacle 46 extending from section 42. Post 45 is carried within a coil spring 47 which is compressed between pivot 44 and receptacle 46. Turning to FIG. 6, a receptacle 46 is illustrated with an open end.

Figure 7:
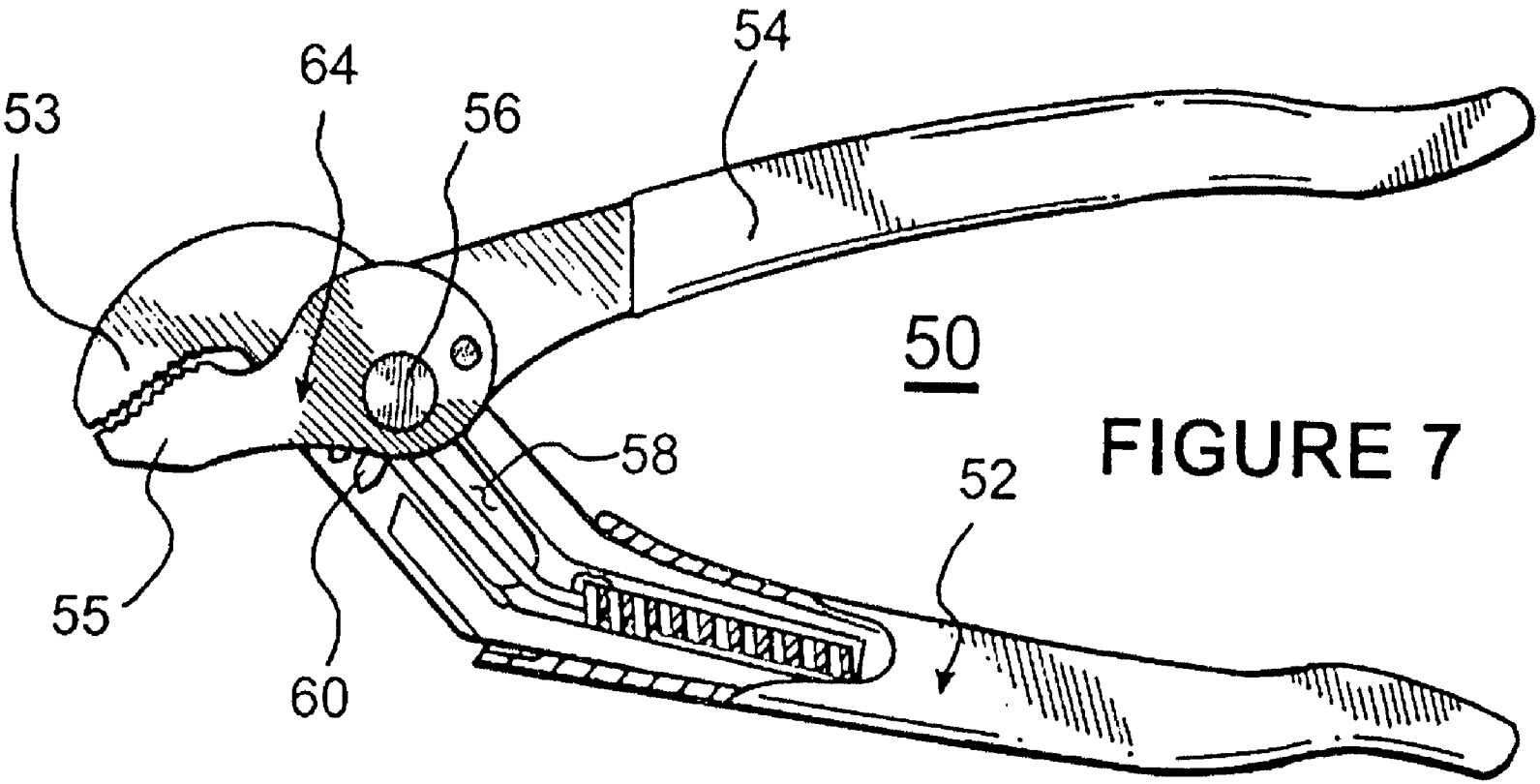
FIG. 7 is a plan view of another embodiment of self adjusting grooved pliers according to the present invention.
Figure 8:
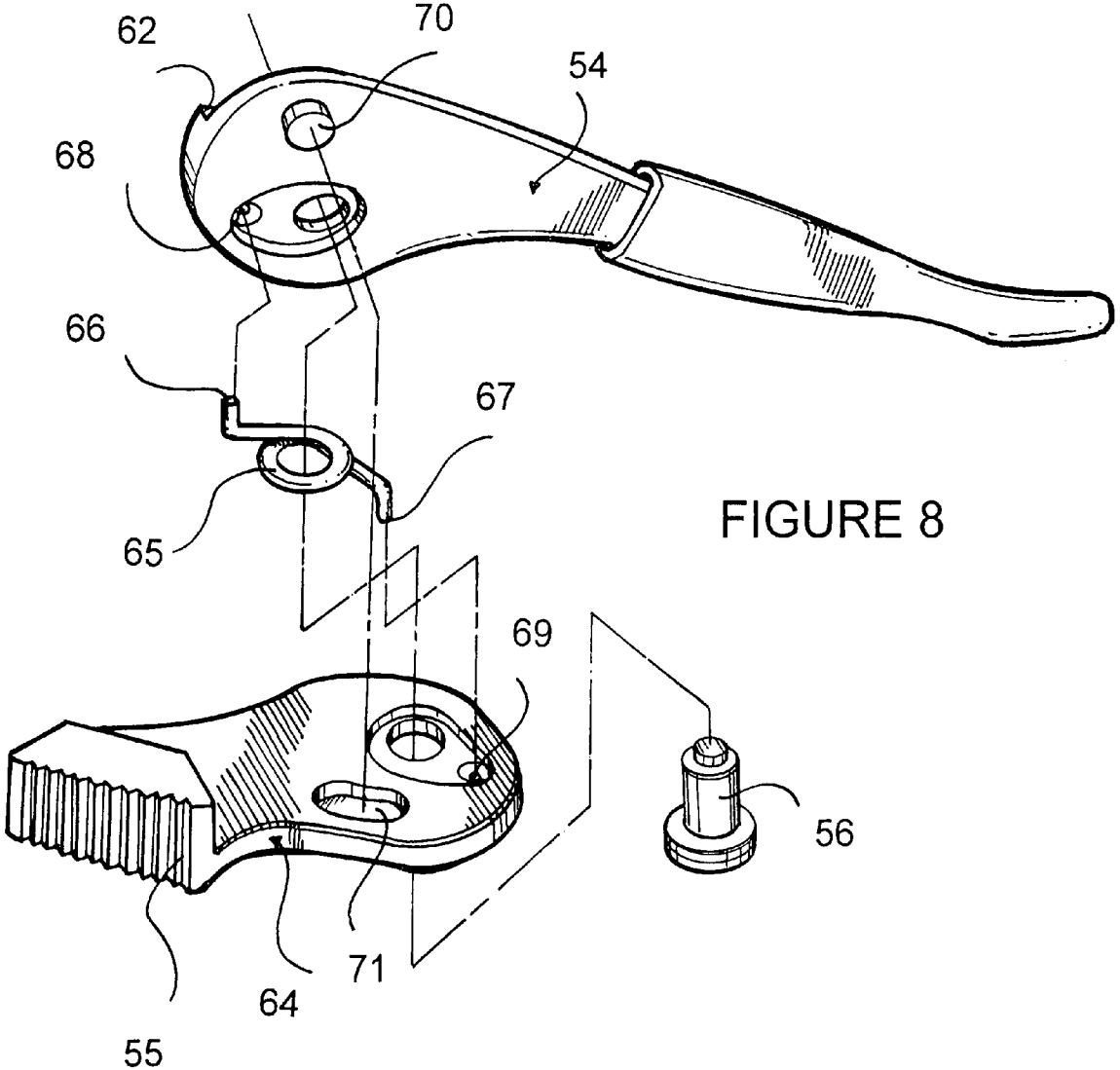
FIG. 8 is an enlarged exploded perspective view of a section of the pliers of FIG. 7.

Referring now to FIGS. 7 and 8, another embodiment of a self adjusting grooved pliers generally designated 50, is illustrated. Pliers 50 are similar to pliers 10, including a section 52 having a jaw portion 53 and a section 54 having a jaw portion 55, pivotally coupled at a pivot 56. Section 52 includes a channel 58 adjacent jaw portion 53, allowing pivot 56 between sections 52 and 54 to be adjusted for a wider or narrower association between jaw portions 53 and 55. Grooves 60 are formed in section 52 proximate channel 58 for receiving a tongue 62 formed on section 54. Tongue 62 is positioned such that it enters one of grooves 60 slightly before or when jaws 53 and 55 come to a substantially parallel position with respect to one another. The difference, in this embodiment, is the construction of section 54. Section 54 includes jaw portion 55 carried by a jaw element 64 pivotally coupled to section 54 between a start position and a finish position. The movement of jaw element 64 is biased into the start position by a spring 65. Spring 65 includes opposing ends 66 and 67 received within depressions 68 and 69 of section 54 and jaw element 64, respectively. Movement of jaw element 64 is limited, in this embodiment, between the start position and the finish position by a pin 70 extending from section 54 and received by a slot 71 formed in jaw element 64.

Figure 9:
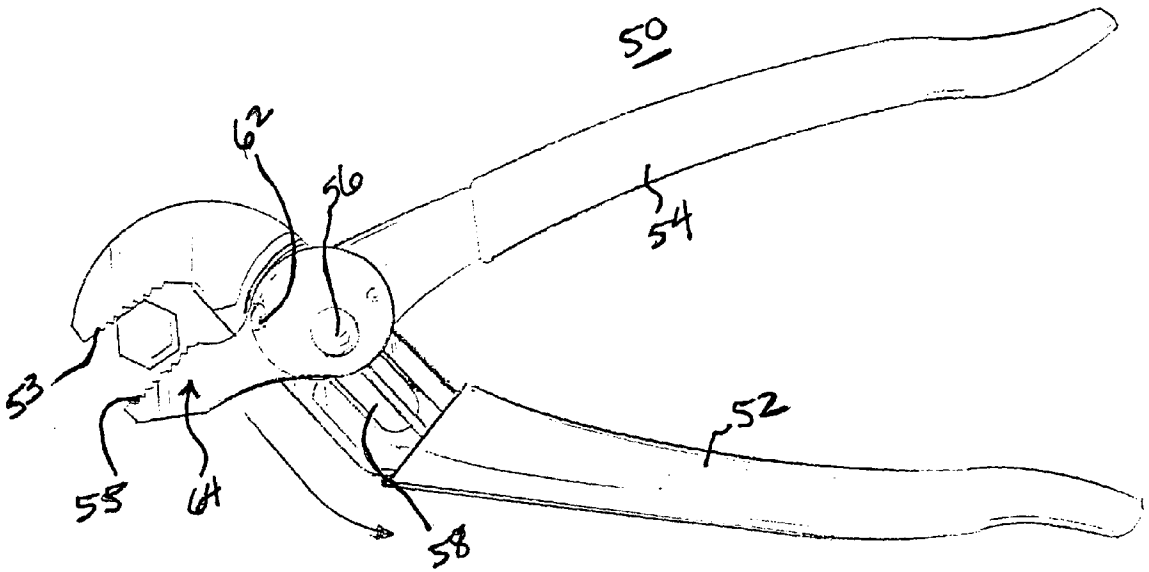
FIG. 9 is a plan view of the pliers of FIGS. 7 and 8 as it appears in the adjusting orientation.
Figure 10:
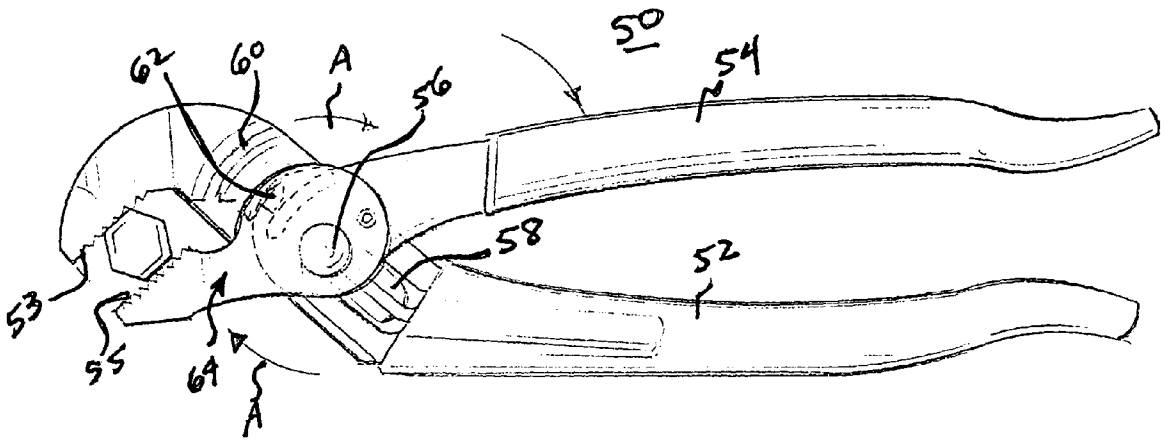
FIG. 10 is a plan view of the pliers of FIGS. 7 and 8 as it appears in the locked orientation.

Referring now to FIGS. 9 and 10, the pivotal movement of jaw element 64 provides more distance of travel of sections 52 and 54 after jaws 53 and 55 become parallel. Thus, as an object is being engaged, as shown in FIG. 9, pivot 56 moves downward. When the object is engaged, and jaws 53 and 55 are substantially parallel, tongue 62 enters one of grooves 60 and prevents further movement of pivot 56 within channel 58. Continued pressure on sections 52 and 54 causes jaw element 64 to pivot toward the finish position. In actual operation, jaw element 64 remains stationary relative the object being clamped, and section 54 continues rotation as illustrated by arrowed arc A until jaw element 64 reaches the finish position. By having section 54 continue rotation, tongue 62 is received further into the one of grooves 60. This provides a stronger and more secure engagement for the application of clamping force to pliers 50.

Figure 12:
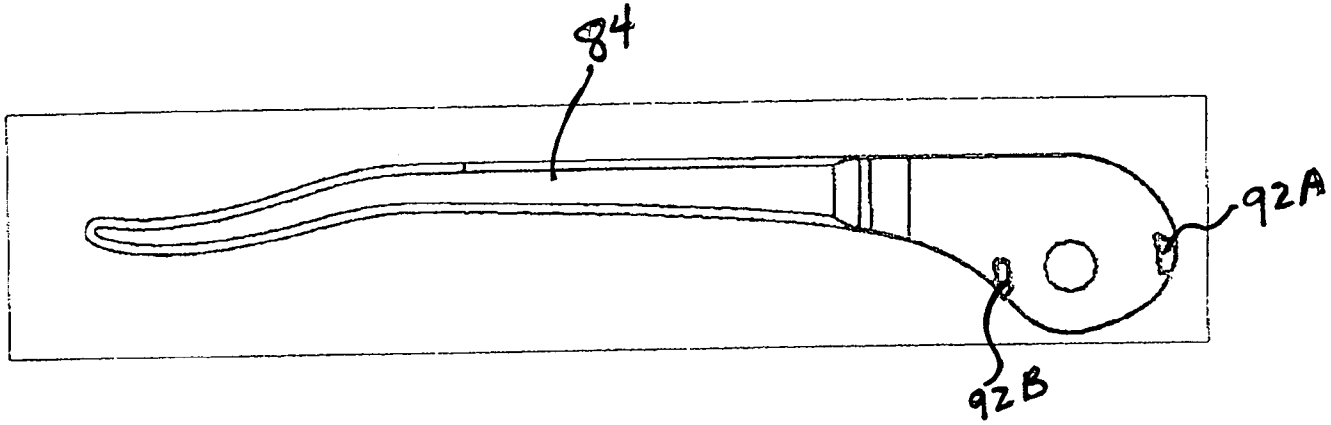
FIG. 12 is a plan view of a section of the pliers of FIG. 11 showing double tongues.
Figure 11:
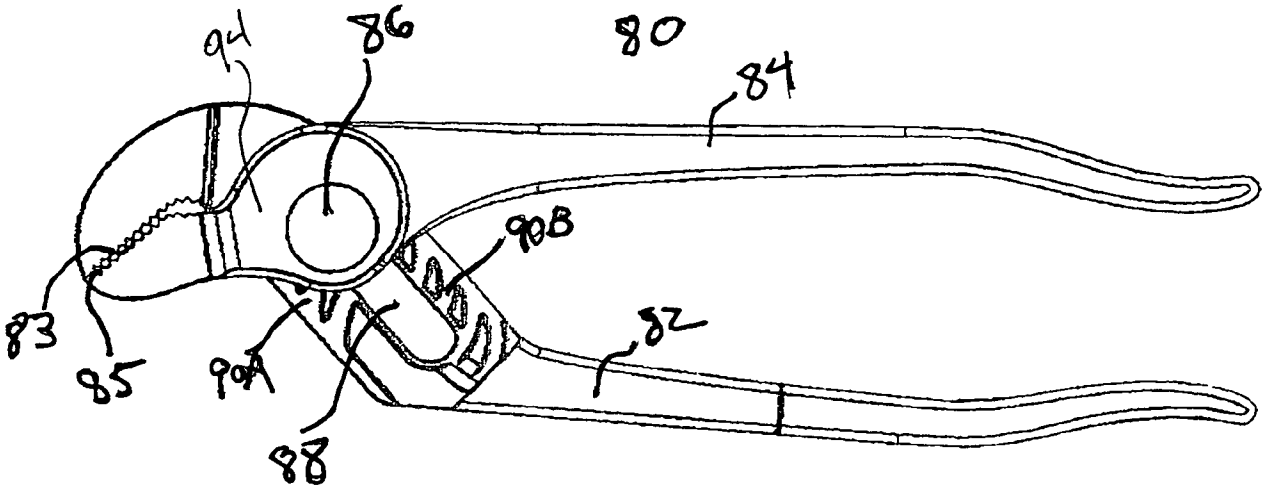
FIG. 11 is a plan view of yet another embodiment of self adjusting grooved pliers according to the present invention.
Figure 13:
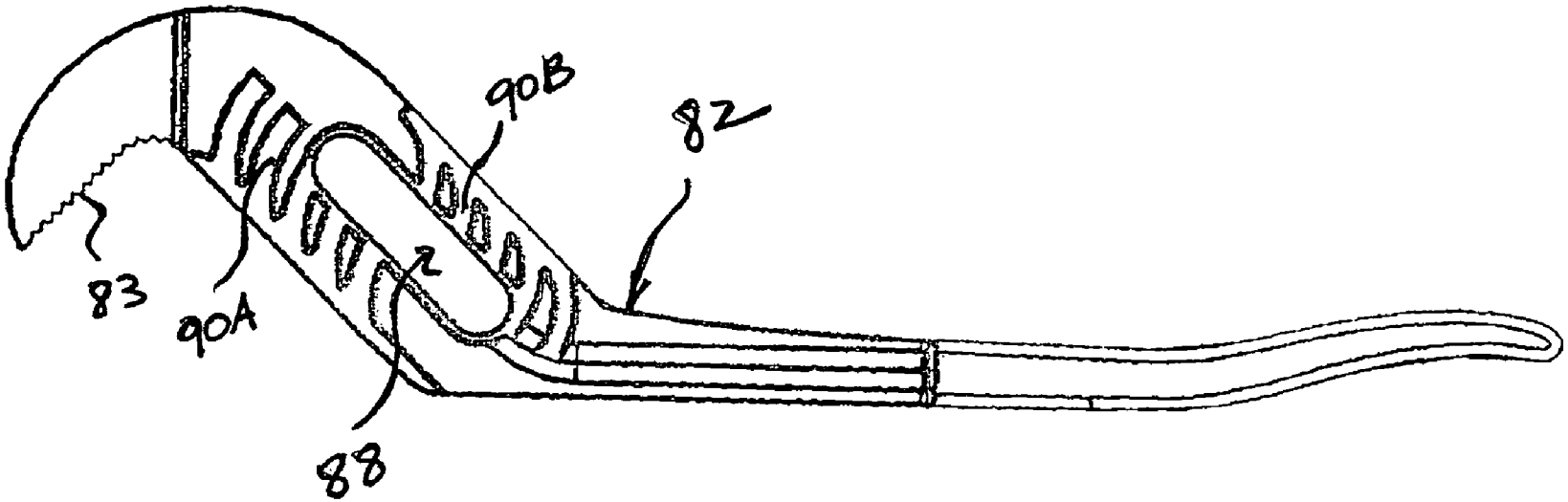
FIG. 13 is a plan view of a section of the pliers of FIG. 11 showing double grooves.

Referring to FIGS. 11, 12 and 13, yet another embodiment of a self adjusting grooved pliers generally designated 80, is illustrated. Pliers 80 are similar to pliers 50, including a section 82 having a jaw portion 83 and a section 84 having a jaw portion 85, pivotally coupled at a pivot 86. Section 82 includes a channel 88 adjacent jaw portion 83, allowing pivot 86 between sections 82 and 84 to be adjusted for a wider or narrower association between jaw portions 83 and 85. In this embodiment, two sets of grooves 90A and 90B are formed in section 52 proximate a leading side top portion of channel 58 and a trailing side bottom portion thereof respectively, for receiving a tongue 92A and a tongue 92B formed on section 84 on substantially opposing sides of pivot 86. Tongues 92A and 92B are positioned such that they enter one of grooves 90A and 90B respectively slightly before or when jaws 83 and 85 come to a substantially parallel position with respect to one another. The difference, in this embodiment, is the use of a pair of tongues and a pair of grooves to provide added strength to pliers 80. Additionally, section 84 can include jaw portion 85 carried by a jaw element 94 pivotally coupled to section 84 between a start position and a finish position. The movement of jaw element 94 is coupled in a manner as shown with pliers 50. Thus, tongues 92A and 92B enter more deeply into grooves 90A and 90B, providing a stronger and more reliable engagement.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and consise terms as to enable those skilled in the art to understand and practice the same, the invention claimed is:

The invention claimed is:

1. Self adjusting grooved pliers comprising:

a first section having a first jaw portion and a channel formed therethrough, adjacent the first jaw portion;

a second section having a second jaw portion and a pivot extending therefrom and slidably received in the channel to allow wider or narrower association between the first jaw portion and the second jaw portion, the pivot pivotally coupling the first section to the second section for movement between an open position and a gripping position;

a plurality of grooves formed in one of the first section and the second section;

a tongue extending from the other of the first section and the second section, the tongue being received in one of the plurality of grooves, locking the pivot in position within the channel upon the first section and the second section reaching the gripping position; and a biasing assembly which acts on the pivot, urging the pivot upward in the channel toward the first jaw portion, the biasing assembly includes a coil spring fitted into a handle portion of the first section and an extension member having an end engaging the coil spring and an opposing end extending into the channel and engaging the pivot, cooperating to urge the pivot in the channel toward the first jaw portion.

2. Self adjusting grooved pliers as claimed in claim 1 wherein the extension member is formed of a spring material.

3. Self adjusting pliers as claimed in claim 1 wherein the biasing assembly includes a post extending from the pivot into a receptacle extending from the first section and the coil spring carried by the post within the receptacle, the coil spring compressed between the pivot and the receptacle.

4. Self adjusting grooved pliers comprising:

a first section having a first jaw portion and a channel formed therethrough, adjacent the first jaw portion;

a second section having a second jaw portion and a pivot extending therefrom and slidably received in the channel to allow wider or narrower association between the first jaw portion and the second jaw portion, the pivot pivotally coupling the first section to the second section for movement between an open position and a gripping position;

a plurality of grooves formed in one of the first section and the second section;

a tongue extending from the other of the first section and the second section, the tongue being received in one of the plurality of grooves, locking the pivot in position within the channel upon the first section and the second section reaching the gripping position; and wherein the second jaw portion of the second section is carried by a jaw element pivotally coupled to the second section, the jaw element movable between a start position and a finish position, the jaw element being biased into the start position by a biasing member.

5. Self adjusting grooved pliers comprising:

a first section having a jaw portion and a channel formed therethrough, adjacent the jaw portion;

a second section having a jaw portion and a pivot extending therefrom and slidably received in the channel to allow wider or narrower association between the jaw portion of the first section and the jaw portion of the second section, the pivot pivotally coupling the first section to the second section for movement between an open position and a gripping position;

a plurality of grooves formed in the first section;

a tongue extending from the second section, the tongue being received in one of the plurality of grooves, locking the pivot in position within the channel only upon the first section and the second section reaching the gripping position; and a biasing assembly which acts on the pivot, urging the pivot upward in the channel toward the jaw portion of the first section, wherein the biasing assembly includes a coil spring fitted into a handle portion of the first section and an extension member having an end engaging the coil spring and an opposing end extending into the channel and engaging the pivot, cooperating to urge the pivot in the channel toward the jaw portion of the first section.

6. Self adjusting grooved pliers as claimed in claim 5 wherein the extension member is formed of a spring material.

7. Self adjusting pliers as claimed in claim 5 wherein the biasing assembly includes a post extending from the pivot into a receptacle extending from the first section and the coil spring carried by the post within the receptacle, the coil spring compressed between the pivot and the receptacle.

8. Self adjusting pliers as claimed in claim 5 wherein the jaw portion of the second section is carried by a jaw element pivotally coupled to the second section, the jaw element movable between a start position and a finish position, the jaw element being biased into the start position by a biasing member.

* * * * *